US006405968B2

(12) United States Patent
Flamm et al.

(10) Patent No.: US 6,405,968 B2
(45) Date of Patent: Jun. 18, 2002

(54) BOBBIN WINDING MACHINE

(75) Inventors: Franz-Josef Flamm, Stolberg; Harald Müllers, Erkelenz, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/747,620

(22) Filed: Dec. 22, 2000

(30) Foreign Application Priority Data

Dec. 23, 1999 (DE) ..... 199 62 296

(51) Int. Cl.[7] ..... B65H 54/42; B65H 54/54; B65H 54/22; B65H 67/00

(52) U.S. Cl. ..... 242/486.4; 242/473.4; 242/473.5; 242/486.1; 242/486.2; 242/486.3

(58) Field of Search ..... 242/486.4, 486.1, 242/486.2, 486.3, 473.4, 473.5, 470

(56) References Cited

U.S. PATENT DOCUMENTS

| | | | | |
|---|---|---|---|---|
| 3,697,007 A | * | 10/1972 | Taylor et al. | 242/486.4 |
| 4,120,462 A | * | 10/1978 | Raasch et al. | 242/486.4 X |
| 5,112,000 A | * | 5/1992 | Derichs et al. | 242/486.4 |
| 5,163,631 A | * | 11/1992 | Borer | 242/486.4 |
| 5,639,036 A | * | 6/1997 | Flamm | 242/486.2 |
| 6,206,320 B1 | * | 3/2001 | Kusters et al. | 242/477.4 |
| 6,349,896 B1 | * | 2/2002 | Adcock et al. | 242/486.4 X |

FOREIGN PATENT DOCUMENTS

| | | | | |
|---|---|---|---|---|
| CH | 3 79 360 | | 8/1964 | |
| DE | 39 13 793 | A1 | 11/1989 | |
| DE | 39 27 142 | A1 | 2/1991 | |
| DE | 4239579 | A1 * | 5/1994 | 242/486.2 X |
| DE | 198 17 363 | A1 | 10/1999 | |
| JP | 62-215472 | | 9/1987 | |
| JP | 1-294172 | | 11/1989 | |

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

In a bobbin winding machine with multiple winding heads, each having a creel associated with a torque transmitter (15) adjusted by a drive element (16) for controlling the bearing load between a bobbin (10) held in the creel and a drive drum (14), buttons (18, 19) are provided for actuation by an operator for adjusting the drive element (16) and therewith the creel (12) for adaptation to a diameter of a residual bobbin to be inserted into the creel (12).

7 Claims, 1 Drawing Sheet

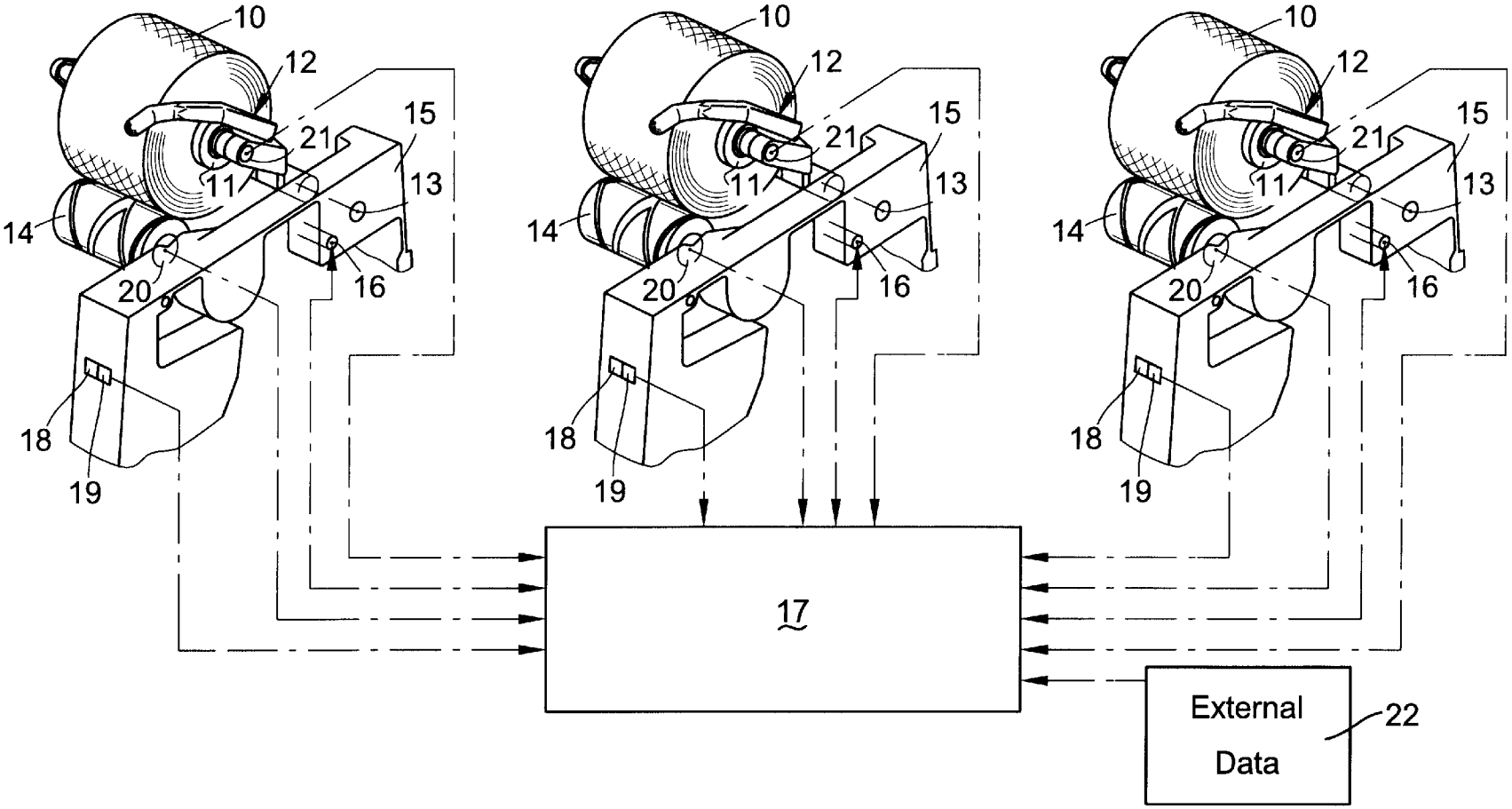
10
11
12
13
14
15
16
17
18
19
20
21
22
External
Data

BOBBIN WINDING MACHINE

CROSS-REFERENCES TO RELATED APPLICATIONS

This application claims the benefit of German patent application No. 199 62 296.5, filed Dec. 23, 1999, herein incorporated by reference.

FIELD OF THE INVENTION

The present invention relates to a bobbin winding machine with multiple winding heads, each of which includes a creel associated with a torque transmitter for controlling the bearing load between a bobbin held- in the creel and a driving drum, which torque transmitter can be adjusted by a drive element controlled by a winding-head computer connected to transmitters that detect the speed of the bobbin and the speed of the drive drum.

BACKGROUND OF THE INVENTION

In a bobbin winding machine of the above-described type in which the creels are provided with a device corresponding to German Patent Publication DE 19 817 363 A1 the bearing load between the bobbin and the drive drum is exactly controlled over the entire course of bobbin winding. The bearing load is comprised of the combined weight of the bobbin and the creel together with the force resulting from the torque applied by the torque transmitter. The winding-head computer is connected to transmitters that detect the speed of the drive drum and the speed of the cross-wound bobbin. All moments that act on the creel can be calculated from these values, taking into consideration the density of the bobbin determined by the yarn tension and the yarn count. The bobbin control can then regulate the torque transmitter by regulating the drive element such that the desired bearing load or the desired course of the bearing load is exactly maintained.

It can occur during the operation of such a bobbin winding machine, especially during a batch change, that bobbins that are not yet entirely completed, i.e., so-called residual bobbins, are removed from a winding head and set into the creel of another winding head in order to be finished thereat. It can also occur at the end of a batch that a few winding heads are already turned off without the bobbins located therein having attained their full diameter. These residual bobbins are then removed and placed into the remaining winding heads which are still operating in order to be finished therein. As a rule, residual bobbins are also produced at the start of a new batch since the user makes attempts in this phase with different cross-wound bobbin diameters, correction factors, etc., to achieve a bobbin that is optimal for the current application. It is likewise important in adjusting of the automatic bobbin changer to present several full bobbins to a winding head in order to adjust the bobbin changing device with these full bobbins.

Problems can result with the processing of residual bobbins in bobbin winding machines of the above-described type. On the one hand, the bearing load between the bobbin and the drive drum is not correct. On the other hand, it is hardly possible to replace an empty tube with a larger bobbin since the creel has been automatically brought into the position associated with an empty bobbin tube. In order to be able to operate in an exact manner, the diameter and the amount of wound-on yarn of a residual bobbin would have to be entered into the winding-head control in order to suitably adjust the position of the creel for this residual bobbin. However, this is not practical because, on one hand, these values are usually not known and, on the other hand, there is also no possibility at the individual winding heads of entering this data.

SUMMARY OF THE INVENTION

The present invention therefore has the objective of developing a bobbin winding machine of the initially mentioned type in such a manner that the processing of residual bobbins does not pose any problems, that is, that even residual bobbins with a fairly large diameter instead of empty tubes can be placed into a creel and thereafter the bearing load between bobbin and drive drum corresponds at least approximately to the desired course of winding.

This problem is addressed by providing means that can be actuated by an operator for adjusting the drive element and therewith the creel for adaptation to the diameter of the residual bobbin inserted into the creel. The winding head computer calculates the torque to be applied by the torque transmitter using information representing the density of the residual bobbin and information resulting from the adaptation to the diameter of the residual bobbin about the position of the creel before the start of the winding process and controls its drive element accordingly.

In this manner, it is possible for the operator to move the creel into a position that is suitable for the residual bobbin to be inserted, that is, that corresponds at least approximately to its diameter. From this position, the required bearing load is calculated within certain permissible tolerances and, given when the winding head is put in operation, taking into consideration the bobbin density that is known at least to the central computer of the bobbin winding machine and transmitted to the winding head computer. After the winding head has started to run, the winding head computer then calculates, based on the bobbin speed that is now detected in relationship to the speed of the drive drum, the precise bobbin diameter and exactly calculates the weight via the density of the bobbin so that the bearing load is exactly determined thereafter.

A position of the creel that substantially corresponds exactly to the diameter of the residual bobbin can be brought up in an automatic manner with an embodiment of the bobbin winding machine in which the winding-head computer is set such that, after actuation of the afore-described adjusting means, a lifting of the creel initially takes place and at the start of the lowering process of the creel, the drive drum is put into a rotary motion at a low speed. At the start of a detected rotation of the residual bobbin brought about by the drive drum, a control signal is generated that controls the end of the adjusting process for the adaptation to the diameter of the residual bobbin and also initiates the ending of the low speed rotary motion of the drive drum. The speed is advantageously set in such a manner that the surface velocity of the drive drum is approximately 50 m/min, which prevents damaging of the residual bobbin.

Further features and advantages of the invention will be understood from the following description of an exemplary embodiment shown in the accompanying drawing.

BRIEF DESCRIPTION OF THE DRAWING

The drawing is a schematic view of a portion of several winding heads of a multi-head bobbin winding machine in accordance with a preferred embodiment of the present invention.

DETAILED DESCRIPTION OF THE PREFERRED EMBODIMENT

Referring now to the accompanying drawing, a yarn is drawn from a spinning bobbin (not shown) at each winding head of a bobbin winding machine and wound onto a conical or cylindrical cross-wound bobbin 10, sometimes referred to as a cheese. Cross-wound bobbin 10 comprises a central interior bobbin tube onto which the yarn or thread is wound. Cross-wound bobbin 10 is held between two conical end plates 11 of a creel 12 by their clamping engagement with the opposite ends of the bobbin tube. Creel 12 is pivotably supported in a machine frame by shaft 13.

Cross-wound bobbin 10 rests on drive drum 14, that is provided with a reversing thread which effects the crossing placement of the yarn running onto cross-wound bobbin 10. Drive drum 14 is driven by an electromotor (not shown) and, in turn, this drum drives cross-wound bobbin 10 by surface friction.

The bearing load between cross-wound bobbin 10 and drive drum 14 is controlled over the entire course of bobbin winding, that is, from the start of the winding of an empty bobbin tube set into creel 12 to the completion of cross-wound bobbin 10 with a given final diameter and/or given final weight.

The bearing load between cross-wound bobbin 10 and drive drum 14 is comprised of a weight component of cross-wound bobbin 10, a weight component of creel 12 and a torque applied by torque transmitter 15 onto shaft 13 of creel 12. The torque of torque transmitter 15 is adjusted by means of adjusting element 16, in particular by a stepping motor. Torque transmitter 15 and adjusting element 16 are designed, e.g., according to German Patent Publication DE 19 817 363 A1. The position of drive element 16 and therewith the torque of torque transmitter 15 and finally the bearing load between cross-wound bobbin 10 and drive drum 14 are controlled by winding head computer 17. The winding head computer 17 is connected to a speed transmitter 20 that enters the speed of drive drum 14 into the winding head computer. Furthermore, a speed transmitter 21 is connected to winding head computer 17 which transmitter 21 detects the drive speed of cross-wound bobbin 10 or of clamping end plate 11 rotating at the same speed. Based on this data, winding head computer 17 calculates the instantaneous diameter of cross-wound bobbin 10.

In addition, further external data 22 is entered into winding head computer 17, especially a yarn tension adjusted during winding and/or the yarn count, so that winding head computer 17 can not only calculate the instantaneous diameter of cross-wound bobbin 10 but also the wound yarn length and the weight of cross-wound bobbin 10. Then, the torque to be applied by torque transmitter 15 is calculated with the aid of this data and drive element 16 is appropriately adjusted to produce this calculated torque. It is possible in this manner to exactly control the bearing load between cross-wound bobbin 10 and drive drum 14 over the entire course of bobbin winding, that is, from the start of the winding of an empty bobbin tube to the completion of the cross-wound bobbin with a given diameter and/or a given weight. Bobbins with a very uniform density can be produced in this manner. The density can be detected and stored, e.g., in winding head computer 17.

It repeatedly occurs during the operation of a bobbin winding machine that partially wound cross-wound bobbins 10 have to be placed into creel 12 of a winding head. The winding head shown is designed in such a manner that such is possible in an uncomplicated manner and that even thereafter the work is carried out with a given bearing load between cross-wound bobbin 10 and drive drum 14 right at the start of the winding process.

Buttons 18, 19 are provided on the winding head that are connected to winding-head control 17. When these buttons are actuated, drive element 16 can be engaged via winding head computer 17 in such a manner that it pivots creel 12 via torque transmitter 15. If, for example, a rather small residual bobbin is to be inserted after a whole cross-wound bobbin 10 has been removed from creel 12, this residual bobbin can be inserted into creel 12. Creel 12 is then lowered by actuating button 18 or 19 until the residual bobbin rests on the circumference of drive drum 14. Winding head computer 17 receives information about the diameter of the inserted residual bobbin from the path traveled by drive element 16. Using the information about the yarn count, the density and/or the winding tension, computer 17 can approximately calculate the weight of the residual bobbin and therewith also the additional loading by torque transmitter 15 required to obtain the desired bearing load. Winding head computer 17 then adjusts drive element 16 of torque transmitter 15 accordingly, so that the desired bearing force is at least approximately adjusted before the starting of the winding head.

A similar course of operation results if, e.g., instead of an empty bobbin tube an almost full residual bobbin is inserted, for which creel 12 must first be pivoted sufficiently upwardly by actuating button 18 or 19 that the residual bobbin can be inserted. The operator then pivots creel 12 with the inserted residual bobbin downwardly in the reverse direction by actuating button 18 or 19 until this bobbin rests on drive drum 14. Even in this instance, winding head computer 17 has information available about the diameter of the residual bobbin on account of the path of drive element 16.

After the actuation of button 18 or 19, the pivoting up of creel 12 and the insertion of the residual bobbin by the operator, a rotary motion of drive drum 14 is brought about at a low speed by winding head computer 17 at the start of the lowering process of creel 12. The adjusted speed corresponds to a surface velocity of drive drum 14 of approximately 50 m/min. After sufficient contact has been established between drive drum 14 and the residual bobbin by the lowering of creel 12, the residual bobbin begins to rotate by means of friction. The start of frictional contact between the residual bobbin and drive drum 14 can be detected or visually recognized exactly by the start of the rotation of the residual bobbin. The diameter of the residual bobbin can be exactly determined with the beginning of the rotary motion. A control signal can be obtained by the detection of this rotary motion of the residual bobbin or of bobbin clamping plates 11 starting at the same speed with a speed transmitter and the extent of the adjusting process of creel 12 can be controlled by winding head computer 17 in such a manner that the position of creel 12 is precisely adapted to the diameter of the residual bobbin. The presence of the control signal indicating the start of the rotation of the residual bobbin initiates the ending of the rotary motion of drive drum 14 at a low speed. Thus, the adjusting process can be automated.

For reasons of presentation, buttons 18 and 19 are associated with the winding head in the exemplary embodiment. They can of course also be provided in a practical machine on the central input unit of the machine control by means of which each individual winding head can be addressed. Individual buttons for actuating drive element 16 or for initiating the pivoting process or key combinations can then be provided in the input unit for this actuation.

Information about the density as well as about the yarn tension during winding, that decisively determines the density of cross-wound bobbin 10, can be retrieved from the central control of the bobbin winding machine for the calculations. However, this information can also be filed in a memory of winding head computer 17 and retrieved therefrom as required.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, departing from the substance or scope of the present invention. Accordingly, while the present invention has been described herein in detail in relation to its preferred embodiment, it is to be understood that this disclosure is only illustrative and exemplary of the present invention and made merely for purposes of providing a full and enabling disclosure of the invention. The foregoing disclosure is not intended or to be constructed to limit the present invention or otherwise to exclude any such other embodiments, adaptations, variations, modifications and equivalent arrangements, the present invention being limited only by the claims appended hereto and the equivalents thereof.

What is claimed is:

1. A bobbin winding machine comprising multiple winding heads each having a drive drum for driving rotation of a bobbin for winding thereof, a creel for holding the bobbin in frictional surface driving engagement with the drive drum, a torque transmitter associated with the creel for controlling a bearing load between the bobbin and the drive drum, a drive element for adjusting the torque transmitter, a winding head computer for controlling the drive element, transmitters connected with the winding head computer for detecting a speed of the bobbin and a speed of the drive drum, and means actuable by an operator for adjusting the drive element and therewith the creel for adaptation to a diameter of a residual bobbin to be inserted into the creel.

2. The bobbin winding machine according to claim 1, characterized in that the winding head computer is adapted to calculate a torque to be applied by the torque transmitter based upon information representing a density of the residual bobbin and information about a position of the creel resulting from the adaptation to the diameter of the residual bobbin before starting of the winding process and the winding head computer is adapted to regulate correspondingly the drive element of the torque transmitter.

3. The bobbin winding machine according to claim 2, characterized further by means for signaling an adjusted winding tension to the winding head computer for representing the density of the residual bobbin.

4. The winding machine according to claim 3, characterized in that a signal about the winding tension is stored in each winding head computer.

5. The bobbin winding machine according to claim 1, characterized in that the winding head computer is operative after actuation of the adjusting means, after a raising of the creel and at the start of a subsequent lowering of the creel, to initiate a low-speed rotation of the drive drum and, upon a detected rotation of the residual bobbin by the drive drum, to generate a control signal for stopping the adjustment means for adaptation to the diameter of the residual bobbin and for stopping the low-speed rotation of the drive drum.

6. The bobbin winding machine according to claim 5, characterized in that the winding head computer is operative to adjust the low rotational speed of the drive drum at approximately 50 m/min.

7. The bobbin winding machine according to claim 1, characterized further by a control panel having at least one button for adjusting the drive element of the torque transmitter.

* * * * *